US005666585A

United States Patent [19]

Nagira et al.

[11] Patent Number: 5,666,585

[45] Date of Patent: Sep. 9, 1997

[54] MAINTENANCE SUPERVISING SYSTEM FOR AN IMAGE-REPRODUCING SYSTEM

[75] Inventors: Jiro Nagira; Yuji Yamashita; Yasuhiro Hashimoto; Fumio Aizawa, all of Osaka, Japan

[73] Assignee: Mita Industrial Co. Ltd., Osaka, Japan

[21] Appl. No.: 563,251

[22] Filed: Nov. 27, 1995

[30] Foreign Application Priority Data

Nov. 28, 1994 [JP] Japan ..... 6-293378

[51] Int. Cl.[6] ..... G03G 21/00

[52] U.S. Cl. ..... 399/10; 358/296; 358/406; 399/9

[58] Field of Search ..... 358/296, 300, 358/406, 504; 355/200–208; 399/9, 10, 11, 12, 24

[56] References Cited

U.S. PATENT DOCUMENTS

| | | | |
|---|---|---|---|
| 5,101,233 | 3/1992 | Ito et al. | 399/10 |
| 5,127,012 | 6/1992 | Hiliger | 355/205 |
| 5,200,779 | 4/1993 | Nawata | 355/206 |
| 5,202,726 | 4/1993 | McCulley et al. | 355/206 |
| 5,303,005 | 4/1994 | Takano et al. | 255/202 |
| 5,325,156 | 6/1994 | Ulinski | 399/24 |
| 5,343,276 | 8/1994 | Yamashita et al. | 355/202 |
| 5,381,242 | 1/1995 | Fujii | 358/406 |
| 5,489,971 | 2/1996 | Nam | 355/208 |
| 5,517,282 | 5/1996 | Yamashita et al. | 355/202 |

FOREIGN PATENT DOCUMENTS 38 36 890 5/1989 Germany .

*Primary Examiner*—Peter S. Wong
*Assistant Examiner*—Derek J. Jardieu
*Attorney, Agent, or Firm*—Shinjyu Office of Patent Attorneys

[57] ABSTRACT

In the host computer of a multiple photocopier management system, a maintenance supervising system is provided for supervising maintenance job contents on routinely serviced photocopier components. Stored in the host computer RAM are maintenance tables for retaining in routine maintenance sequences job items for periodic maintenance on the photocopier components. After completing routine maintenance on a photocopier, a service engineer inputs maintenance reporting data which is accepted in job store areas of the RAM. The maintenance reporting data categorizes a maintenance job, in particular as to whether a component has been repaired, and indicates actual job content, component-by-component. The routine maintenance sequences each constitute an order of ranking numbers each assigned to a job item, and the rank order in the sequence is updated according to the ranking number corresponding to the content of the reported job. Based on the maintenance reporting data accepted by the RAM, and on the updated job rank orders in the routine maintenance sequences, the host computer sets job items component-by-component for the next-scheduled routine maintenance from the job items stored in the maintenance tables. The job items for the work due component-by-component in the next scheduled routine maintenance are accordingly displayed.

9 Claims, 9 Drawing Sheets

Fig. 5

20

| RANKING NUMBER / COMPONENT NAME | 0 | 1 | 2 | 3 | 4 |
|---|---|---|---|---|---|
| CONTACT GLASS | CLEANING | * * * * | CLEANING | <<<< | |
| PHOTOSENSITIVE DRUM | * * * * | ADJUSTMENT | * * * * | REPLACEMENT | <<<< |
| UPPER PAPER SUPPLY ROLLER | * * * * | CLEANING | INSPECTION/ REPLACEMENT | >>>> | |

Fig. 6

| DISPLAY | JOB CONTENTS |
|---|---|
| REPLACEMENT | REPLACE |
| CLEANING | CLEAN |
| OILING | OIL |
| ADJUSTMENT | ADJUST |
| INSPECTION | INSPECT |
| IGNORE MAINT. | OTHER THAN SUBJECT MAINTENANCE (REPAIR MAINTENANCE) |
| **** | NO NEED TO PERFORM MAINTENANCE |
| INSPECTION/ REPLACEMENT | INSPECT; WHERE NECESSARY REPLACE |
| INSPECTION/ REPLACEMENT | INSPECT; WHERE NECESSARY CLEAN |
| INSPECTION/ REPLACEMENT | INSPECT; WHERE NECESSARY OIL |
| INSPECTION/ REPLACEMENT | INSPECT; WHERE NECESSARY ADJUST |
| CLEANING/ OILING | OIL UPON CLEANING |
| CLEANING/ ADJUSTMENT | ADJUST UPON CLEANING |
| OILING/ ADJUSTMENT | ADJUST UPON OILING |
| <<<< | INDICATES RETURN TO HEAD OF MAINTENANCE CYCLE (NOT ITSELF A JOB) |
| >>>> | INDICATES REPEAT OF LAST (ONE PREVIOUS) JOB CONTENT (NOT ITSELF A JOB) |

Fig. 7

21

| COUNTER NAME | COUNT VALUE |
|---|---|
| TOTAL COUNTER | 632, 450 |
| UPPER-LEVEL PAPER SUPPLY COUNTER | 358, 210 |
| MIDDLE-LEVEL PAPER SUPPLY COUNTER | 213, 153 |
| LOWER-LEVEL PAPER SUPPLY COUNTER | 52, 087 |
| SORTER COUNTER | 153, 050 |
| ADF COUNTER | 241, 030 |

21a
22a
22b
22c
21b
23a
21c
23b

Fig. 8

24a 24 24b

| COMPONENT NAME | USAGE COUNTER | SANCTION COUNTER |
|---|---|---|
| PHOTOSENSITIVE DRUM | 125, 321 | 400, 000 |
| UPPER PAPER SUPPLY ROLLER | 72, 311 | 600, 000 |
| MIDDLE PAPER SUPPLY ROLLER | 21, 511 | 600, 000 |
| | | |

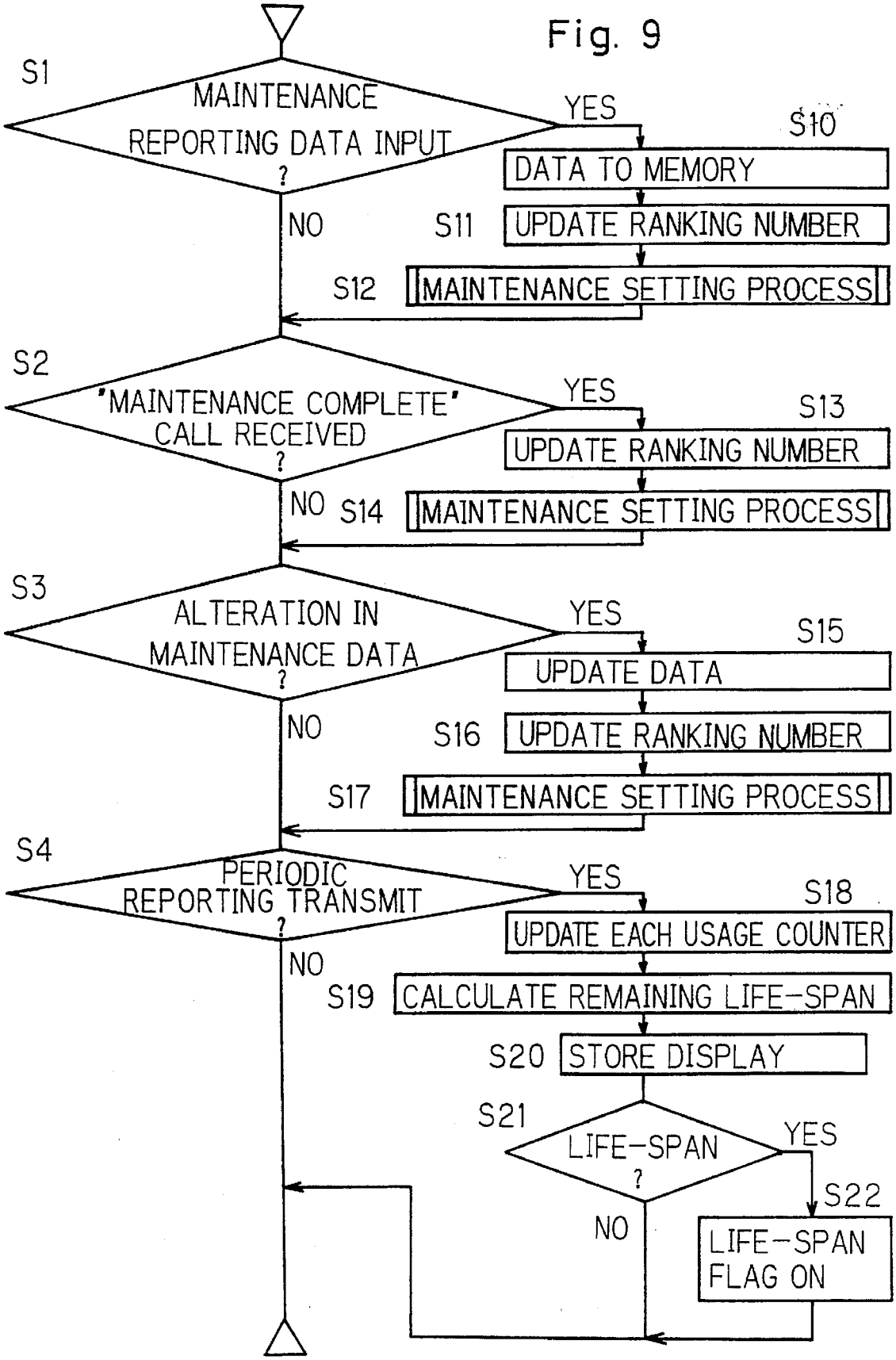
Fig. 9
S1
MAINTENANCE REPORTING DATA INPUT ?
YES
S10
DATA TO MEMORY
NO
S11
UPDATE RANKING NUMBER
S12
MAINTENANCE SETTING PROCESS
S2
"MAINTENANCE COMPLETE" CALL RECEIVED ?
YES
S13
UPDATE RANKING NUMBER
NO
S14
MAINTENANCE SETTING PROCESS
S3
ALTERATION IN MAINTENANCE DATA ?
YES
S15
UPDATE DATA
NO
S16
UPDATE RANKING NUMBER
S17
MAINTENANCE SETTING PROCESS
S4
PERIODIC REPORTING TRANSMIT ?
YES
S18
UPDATE EACH USAGE COUNTER
NO
S19
CALCULATE REMAINING LIFE-SPAN
S20
STORE DISPLAY
S21
LIFE-SPAN ?
YES
S22
NO
LIFE-SPAN FLAG ON

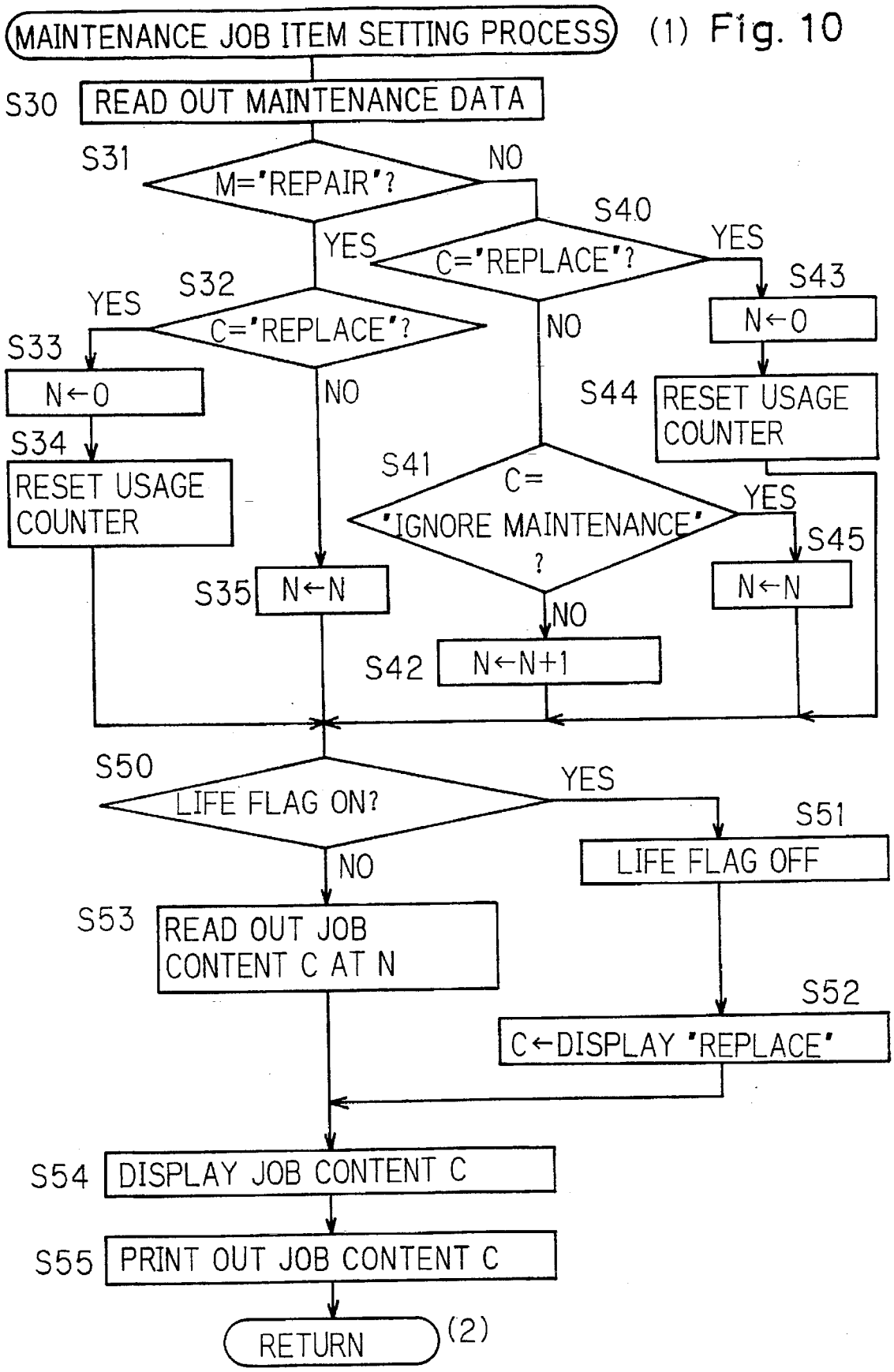
MAINTENANCE JOB ITEM SETTING PROCESS
(1)
Fig. 10
S30
READ OUT MAINTENANCE DATA
S31
M='REPAIR'?
NO
YES
S40
C='REPLACE'?
YES
S43
N←0
S32
C='REPLACE'?
YES
NO
S33
N←0
NO
S44
RESET USAGE COUNTER
S34
RESET USAGE COUNTER
S41
C= 'IGNORE MAINTENANCE' ?
YES
S45
N←N
S35
N←N
NO
S42
N←N+1
S50
LIFE FLAG ON?
YES
S51
LIFE FLAG OFF
NO
S53
READ OUT JOB CONTENT C AT N
S52
C←DISPLAY 'REPLACE'
S54
DISPLAY JOB CONTENT C
S55
PRINT OUT JOB CONTENT C
RETURN
(2)

MAINTENANCE SUPERVISING SYSTEM FOR AN IMAGE-REPRODUCING SYSTEM

BACKGROUND OF THE INVENTION

1. Technical Field

The present invention relates to a maintenance supervising system for an image-reproducing system, and in particular relates to a maintenance supervising system which monitors maintenance of, and schedules maintenance job contents for, the routinely serviced components in an image-reproducing system.

2. Description of Related Art

In general, the routine maintenance of image-reproducing devices such as photocopiers and the like is carried out in accordance with a service manual. The manual lists, in component-by-component sequence for each regularly maintained component, instructions describing maintenance work that should be carried out on the components each time a certain image-reproducing count is reached (for example every 100,000 photocopies). The count indicates the age of an original or replaced component. A serviceman visits the site of a photocopier installation at a period of time predetermined after the last scheduled maintenance according to when the age count is expected to have been exceeded. After referring to the service manual for instructions as to the maintenance work due, the serviceman carries out maintenance work accordingly.

Moreover, in a management system wherein a plurality of photocopiers are monitored at a service center and are connected via telephone lines to the service center's host computer, dates for the next routine maintenance due are transmitted to the host computer from the photocopiers each time an age count is reached. Once notification is received that routine maintenance is due on a particular photocopying machine, a serviceman will visit the site of the machine installation. There the serviceman carries out maintenance work having consulted the service manual for details of the routine maintenance job.

When maintenance work is accordingly carried out in conformity with a service manual, there is a risk that where components have been serviced or replaced previously due to some unforeseeable problem, during the next regularly scheduled service visit, maintenance work may be carried out unnecessarily on the previously replaced components.

More specifically, due to premature failure, a component may have to be replaced or repaired on an unscheduled occasion. Consequently, the next-scheduled service procedure in accordance with service manual recommendations for the particular component may be rendered unnecessary. Maintenance work, such as cleaning and adjustment, may nonetheless be carried out on the component repaired or replaced in the interim between scheduled maintenance occasions. The consequence is reduced efficiency of routine maintenance procedures, where on the contrary improved efficiency is actually the goal.

SUMMARY OF THE INVENTION

An object of the present invention is to effectively eliminate redundancy in the performance of routine maintenance so as to maintain optimum efficiency of maintenance service procedures.

The maintenance supervising system for an image-reproducing system according to the present invention is a device which supervises maintenance job items for routinely serviced components of an image-reproducing system. The maintenance supervising system is provided with a microprocessor having an input device, a data storage means, and a display, each connected to the microprocessor. Maintenance job items are stored in the data storage means in routine maintenance rank-ordered sequences component-by-component for routinely serviced components of the image-reproducing system. The maintenance job items are component maintenance work to be carried out at elapsed times.

The data storage means is configured to accept and retain component-by-component maintenance reporting data, input by a serviceman via the input device, on actual maintenance jobs carried out on the components of the image reproducing system. The maintenance reporting data includes job content data updating component maintenance status according to the actual maintenance jobs carried out on the components. The maintenance reporting data further includes maintenance categorizing data categorizing the most recent status of maintenance on the serviced components. The data storage means is further configured to hold component-by-component, in response to the job content data, job item immediate rankings from the routine maintenance rank-ordered sequences of the maintenance job items.

The microprocessor sets maintenance job items for succeeding maintenance work component-by-component in the routine maintenance rank-ordered sequences, in response to the maintenance reporting data and the job item immediate rankings held in the data storage means. The display means accordingly displays the maintenance job items set by the microprocessor.

The type of maintenance may include "routine maintenance," non-regular "repair maintenance" and "routine and repair maintenance," and the job content data may designate the content of actual maintenance jobs at least as "replacement," "ignore maintenance" and "other work."

Moreover, when the type of maintenance received by the data-accepting means is "routine maintenance" or "routine and repair maintenance," the microprocessor, when the job content is "replacement," may set the head one of the job contents stored in the routine maintenance rank-ordered sequence in the data storage means; when the job content is "ignore maintenance," the microprocessor may set the immediate one of the job contents in the routine maintenance rank-ordered sequence; and when the job content is "other work," the microprocessor may set the one of the job contents in the routine maintenance rank-ordered sequence next from the immediate one in the sequence.

Furthermore, when the type of maintenance accepted by the data-accepting means is "repair maintenance" the microprocessor may set the head one of the job contents stored in the routine maintenance rank-ordered sequence in the data storage means, and when the job content is "other work," set the mediate one of the job contents in the routine maintenance rank-order sequence.

Moreover, the data storage means is further configured to hold sanctioned image-formation counts, each being a count of image-reproducing system image formations predetermined for sanctioning serviceable life-span of a component before replacement. The data storage means is also further configured to accept and retain counts of image formations by the image-reproducing system. The microprocessor accordingly may determine the life-span of each serviceable component by correlating the image formation count accepted by the data storage means with the sanctioned image-formation counts held previously therein. Thus components which have attained life-span can be replaced reliably during the next routine maintenance.

With the maintenance supervising system for an image-reproducing system of the present invention, when data as to whether or not the type of maintenance most recently actually carried out was repair maintenance, and as to component-by-component maintenance job content, is accepted by the data storage means, the content of the job which should be carried out on each component at the next routine maintenance occasion is set by the microprocessor. The job content is set from the job items stored in the data storage means, based on the type of maintenance and the job content accepted, and on the immediate routine maintenance rank order held from the routine maintenance rank-ordered sequence. The job content set for each component is output for display.

Herein, the next job content is determined from the job content actually carried out (e.g., repair maintenance, etc.), and not just on the basis of routine maintenance. Thus, when for example a replacement operation has been carried out, the job items for the next routine maintenance are set to reflect this fact. Consequently, when the serviceman reviews the output results he can grasp accurately the contents of the jobs scheduled for the next routine maintenance. This will improve the efficiency of the ensuing routine maintenance job.

The types of maintenance include "routine maintenance," non-routine "repair maintenance" and "regular and repair maintenance," and job content includes "replacement," "ignore maintenance" and "other work." Accordingly, it is possible to set routine maintenance work arbitrarily for a succeeding occasion at least according to whether or not the maintenance type is "repair maintenance," and whether or not the job content is "replacement." This can improve the work efficiency of the routine maintenance procedure.

Moreover, when the type of maintenance accepted by the data storage means is "routine maintenance" or "routine and repair maintenance," the microprocessor in this case sets the head one of ranking numbers for the job items when the job content is "replacement," sets the present one of the ranking numbers for the job items when the job content is "ignore maintenance," and sets the next from the present one of the ranking numbers for the job items when the job content is "other work." Accordingly, the job-content setting means accurately sets job items for the succeeding routine maintenance work in response to the immediate type of maintenance.

Furthermore, when the type of maintenance accepted by the data storage means is "repair maintenance," in this case the microprocessor sets the head one of the ranking numbers for the job items when the job content is "replacement," and when the job content is "other work," the microprocessor sets the job content for the present one of the ranking numbers for the job items. Thus the microprocessor can accurately set the job content for the next routine maintenance in response to the most recent type of maintenance.

Moreover, the data storage means, being further configured to retain a plurality of sanctioned image-formation counts, which hold component-by-component for each component a sanctioned number of image formations as a serviceable life-span before replacement, and configured to accept counts of image formations by the image-reproducing system. This makes it possible to determine the life-span of each component from an accepted count of image formations and the corresponding sanctioned image-formation count held in the data storage means. Accordingly, components which have attained life-span count can be replaced reliably during the next routine maintenance procedure.

These and other objects, features, aspects and advantages of the present invention will become more fully apparent from the following detailed description of the present invention when taken in conjunction with the accompanying drawings, where like reference numerals denote corresponding components throughout, in which:

BRIEF DESCRIPTION OF THE DRAWINGS

FIG. 5 is a diagram representing portions of the contents of a maintenance table stored in a maintenance table storage area of the RAM depicted in FIG. 4, of one of the photocopying machines depicted in FIG. 1;

FIG. 6 is a table representing examples of job content which may be held in any of the job store areas of the RAM depicted in FIG. 4;

FIG. 7 is a table representing an example of contents of a counter in a memory unit of the photocopying machine main control system depicted in FIG. 3;

FIG. 8 is a diagram representing an example table of usage counter values held against sanction counter values, listed by component, and stored in a usage-counter store area of the RAM depicted in FIG. 4,;

FIG. 9 is control flow chart illustrating maintenance supervising operations of the main control system;

FIG. 10 is a control flow chart illustrating steps of a maintenance job item setting process of the maintenance supervising operation.

DETAILED DESCRIPTION OF THE PREFERRED EMBODIMENTS

Figure 1:
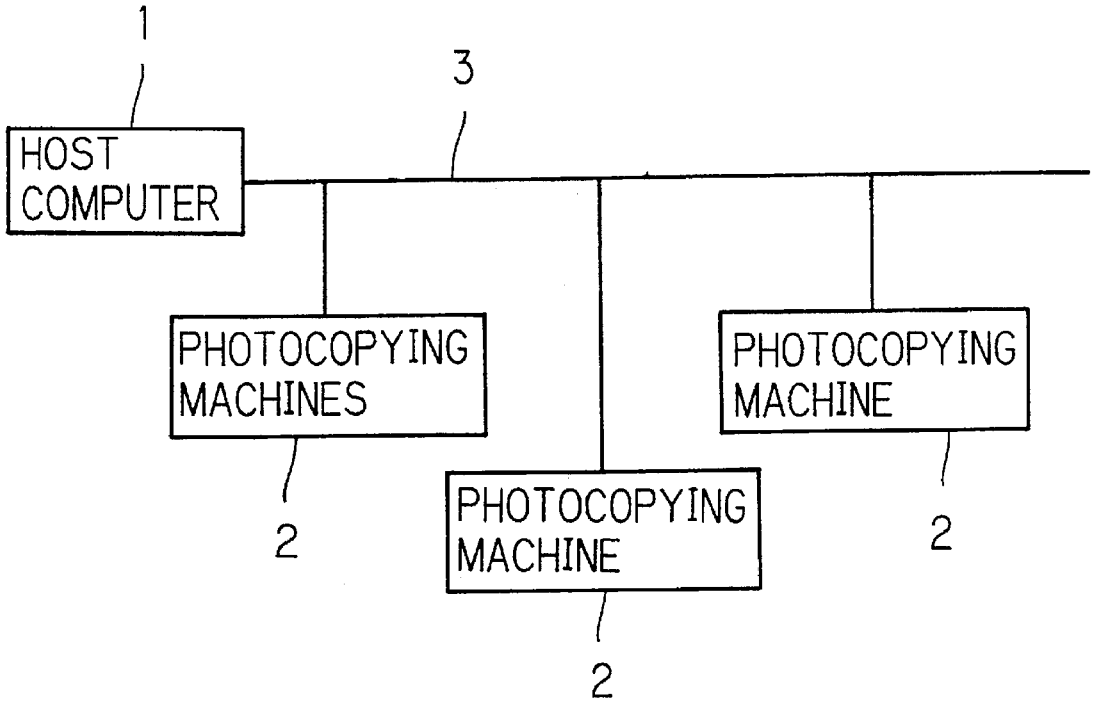
FIG. 1 is a block diagram schematically representing a photocopying machine control network in accordance with one embodiment of the present invention, wherein several photocopying machines are connected electronically to a host computer.

A multiple photocopier management system is shown in FIG. 1. The photocopier management system therein employs an embodiment of the maintenance supervising system for image-reproducing devices of the present invention. The photocopier management system includes host computer 1 provided at a service center, and a plurality of photocopiers 2 connected in a network to the host computer 1 via telephone line 3. It should be understood that instead of the telephone lines 3, transmission lines in a local area network (LAN), for example, could also serve as network lines.

Figure 2:
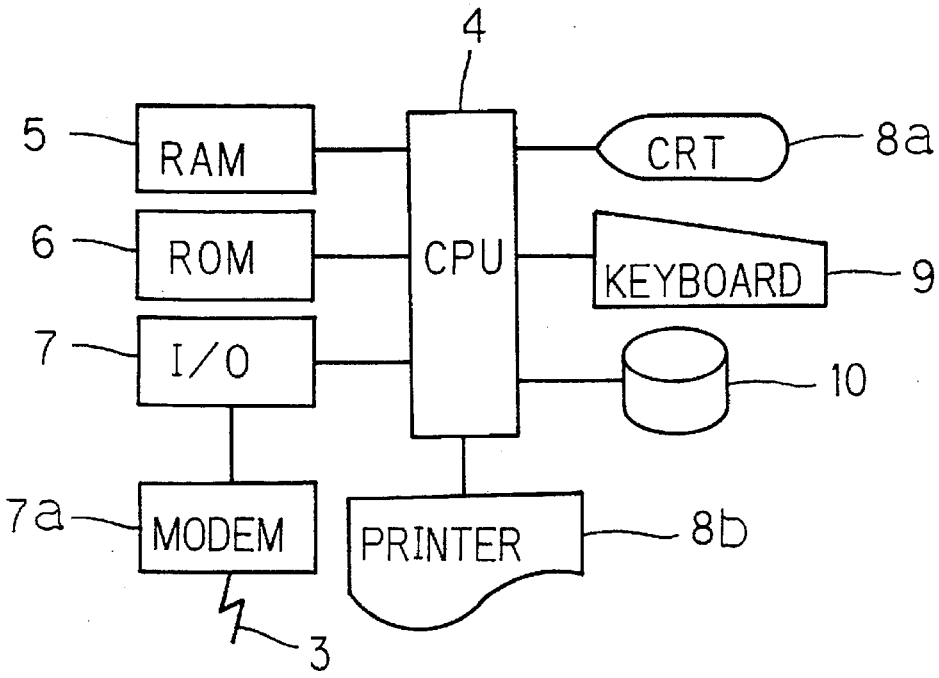
FIG. 2 is a schematic block diagram of various components, including a Random Access Memory (RAM), of the host computer of the control network depicted in FIG. 1.

Host computer 1, as shown in FIG. 2, includes CPU 4, RAM 5 connected to CPU 4, ROM 6, and an input/output interface 7. A display CRT 8*a*, a printer 8*b*, an input keyboard 9 and an external storage device 10 are connected to the CPU 4. The I/O interface 7 is provided with a serial interface such as an RS232C. A modem 7a is connected to the serial interface of the I/O interface 7, and further is connected to a telephone line 3.

Figure 3:
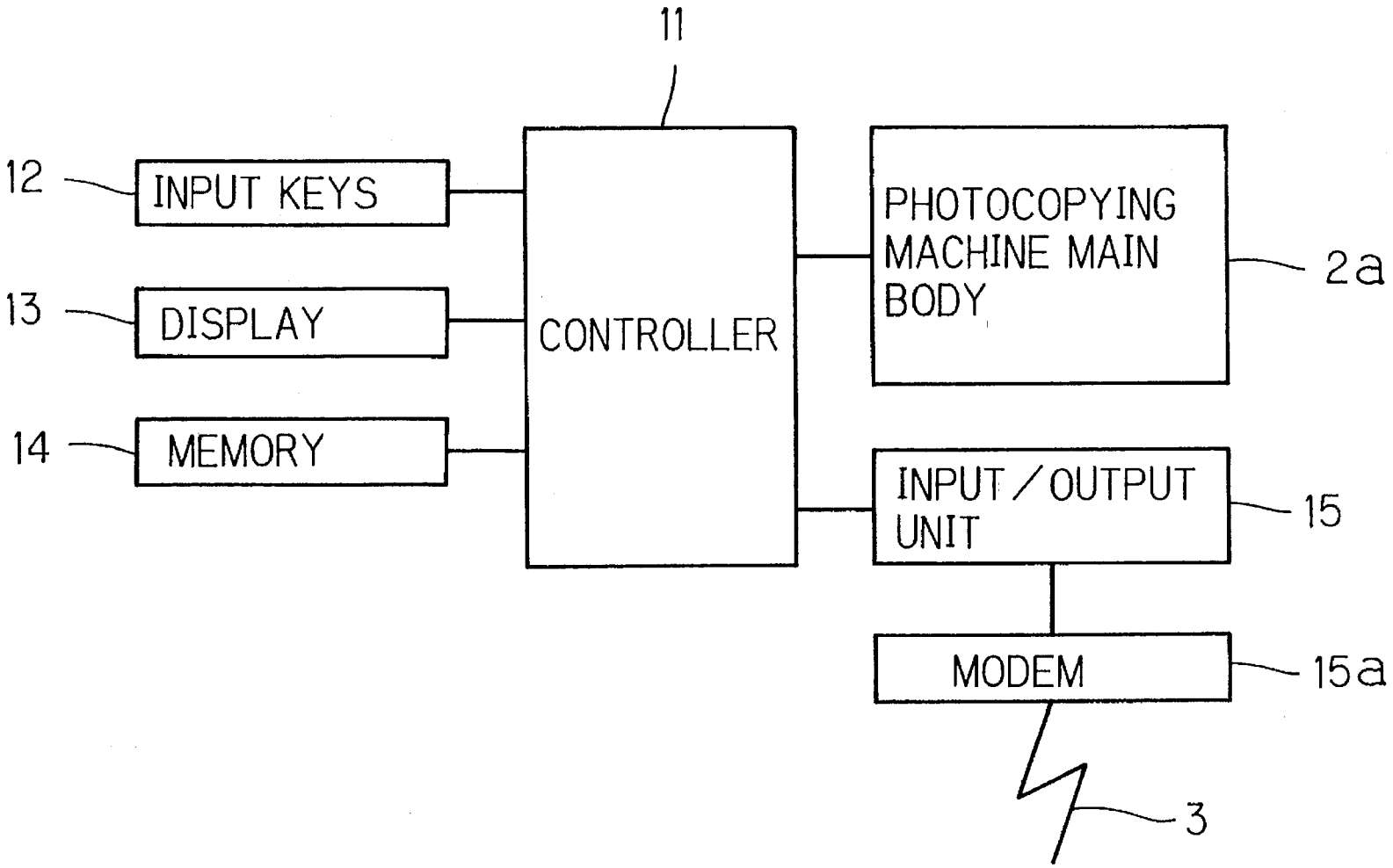
FIG. 3 is a block diagram indicating components of a main control system in one of the photocopying machines depicted in FIG. 1, wherein the main control system supervises photocopying machine maintenance.

Photocopier 2 is provided with controller 11 shown in FIG. 3. Controller 11 is composed of a micro-computer system which contains a CPU, RAM, ROM, a variety of drivers and a variety of I/O devices. Photocopier body 2a, input keys 12 of the operating panel of photocopier 2, and display 13 are connected to controller 11. Moreover, memory 14 for recording miscellaneous working data is also connected to controller 11. Furthermore, input/output unit 15, containing a serial interface such as an RS232C, is connected to controller 11. A modem 15a is connected to the I/O unit 15, and to telephone line 3.

Figure 4:
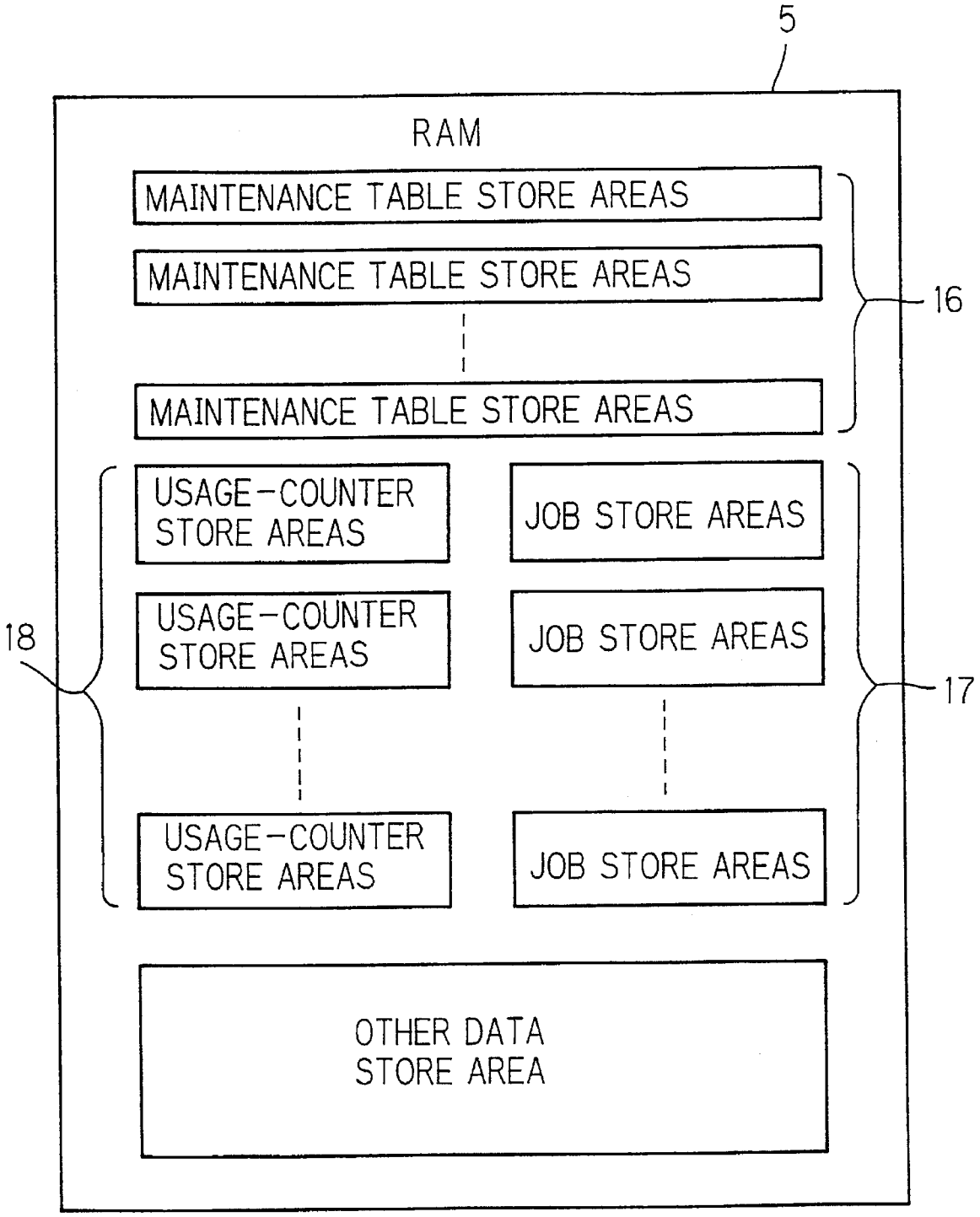
FIG. 4 is a schematic representation of information stored in the RAM of the host computer depicted in FIG. 2.

As shown in FIG. 4, RAM 5 of host computer 1 is provided, for each of photocopiers 2 connected to it, with maintenance table store areas 16, job store areas 17 which each store maintenance reporting data on the most recent maintenance carried out on each component by the serviceman (i.e., the type of maintenance and content of the job done), and the ranking number for each component (to be explained below), and component usage-counter store areas 18, Miscellaneous data are stored in a storage area of RAM 5 for other data.

The type of maintenance work which may be carried out by a serviceman is categorized into three types: "routine maintenance," carried out regularly per set number of photocopies; "repair maintenance," carried out to deal with an unexpected problem; and "routine+repair maintenance," wherein non-routine repair work is done during routine maintenance.

Routine maintenance job items for the maintenance of all of the serviceable components of a photocopier 2 are stored in routine maintenance sequences component-by-component in a maintenance table 20, as shown in FIG. 5. The store areas 16 in RAM 5 accordingly store maintenance tables 20 for each of the plurality of photocopiers 2 in the network managed by the host computer 1. In the FIG. 5 example, job items which should carried out during routine maintenance every predetermined number of photocopies (for example, every 100,000 copies) are noted component-by-component in a ranking number sequence (0, 1, 2, 3, 4) which sets forth a routine maintenance rank-ordering for the component maintenance job items.

The job items, as shown in FIG. 6, include "replacement," "cleaning," "oiling," "adjustment," "inspection," and the like. The job items are displayed on CRT 8a at a predetermined timing.

For example, in the case of the document-table contact glass in an image-reproducing device, cleaning is to be carried out at the 100,000th copy since installation or replacement (i.e., ranking no. 0), no work is to be done at the 200,000th copy (ranking no. 1), and a second cleaning is to be carried out at the 300,000th copy (ranking no. 2). Then at the 400,000th copy (ranking no. 3), the system reverts to the initial ranking number, such that cleaning is to be carried out as the routine maintenance job item.

In the case of the photosensitive drum in a photocopier as another example, nothing need be done at the 100,000th copy since installation or replacement (i.e., ranking no. 0), adjustment is to be carried out at the 200,000th copy (ranking no. 1), and nothing need be done at the 300,000th copy (ranking no. 2). Replacement of the photosensitive drum is then stipulated during servicing at the 400,000th copy (ranking no. 3). At the 500,000th copy (ranking no. 4), the system reverts to the job item of the first ranking number (i.e., 0).

Again in the present photocopier example, for the upper paper supply roller, nothing need be done at the 100,000th copy (ranking no. 0) after installation or replacement, cleaning is carried out at the 200,000th copy (ranking no. 1), and an inspection is carried out at the 300,000th copy (ranking no. 3), at which time it is replaced if necessary. Inspection/replacement are then repeated every 100,000 copies after the 400,000th copy.

Memory 14 of photocopier 2 is provided with a memory area which contains a count table 21 as shown in FIG. 7. Count table 21 holds counts in a total counter 21a; in counter 21b having three level-separated paper supply counters, upper-level, middle-level and lower-level paper-supply counters 22a, 22b 22c; and in option counter 21c having two counters, sorter counter 23a and ADF (Automatic Document Feed) device counter 23b. Total counter 21a computes the number of photocopies made since installation of the photocopier 2. Paper supply level-separated counter 21b computes the number of photocopies in which sheets of paper in each level are used. Option counter 21c computes the number of photocopies in which the sorter, ADF, etc., options are used.

The component usage-counter store areas 18 in RAM 5 in host computer 1 store usage counter tables 24, an example of which is shown in FIG. 8, for each of the photocopiers 2. Each table stores component ages component-by-component as counts in usage counters 24a of image-reproducing operations by a photocopier 2. Each of the usage tables 24 also stores sanctioned component life-span counts in sanction counters 24b for all of the serviceable components of the photocopier 2. The counts in the usage counters 24a are updated by any of: the count in total counter 21a, sent regularly from the photocopier 2, the count in paper supply level-separated counter 21b, or the count in dual-option counter 21c. When the usage-counter store area 18 containing the usage table 24 receives information that a component has been replaced the corresponding usage counter 24a count is reset.

For example, the computed value in usage counter 24a of the photosensitive drum is updated by the current count, and by the count at the time the drum is replaced, in total counter 21a.

The usage counter 24a for the upper-level paper supply roller is updated by the current count, and by the count at the time the roller is replaced, in upper-level paper supply counter 22a. The usage counter 24a for the middle- and lower-level paper supply rollers are likewise updated by the current counts, and by the counts at the time the rollers are replaced, in middle- and lower-level paper supply counters 22b and 22c.

Sanction counters 24b hold counts stipulated beforehand according to manufacturer's predeterminations for each component setting forth the life-span of each component as a number of copies (image-reproducing operations).

The maintenance supervising operation of host computer 1 will now be described, following the control flow charts in FIGS. 9 and 10.

Initially, at step S1 of the maintenance supervising operation according to FIG. 9, a decision is made as to whether maintenance reporting data has been input by a serviceman. When the serviceman returns to the service center having completed maintenance calls, for each serviced photocopier he inputs into host computer 1 maintenance reporting data, which includes both the type of maintenance (i.e., whether the timing of the maintenance visit is classified as "routine", "repair", or "routine and repair"), and the job content (i.e., the actual work performed by the serviceman on each component during that visit). This input is received at step S1.

Figure 11:
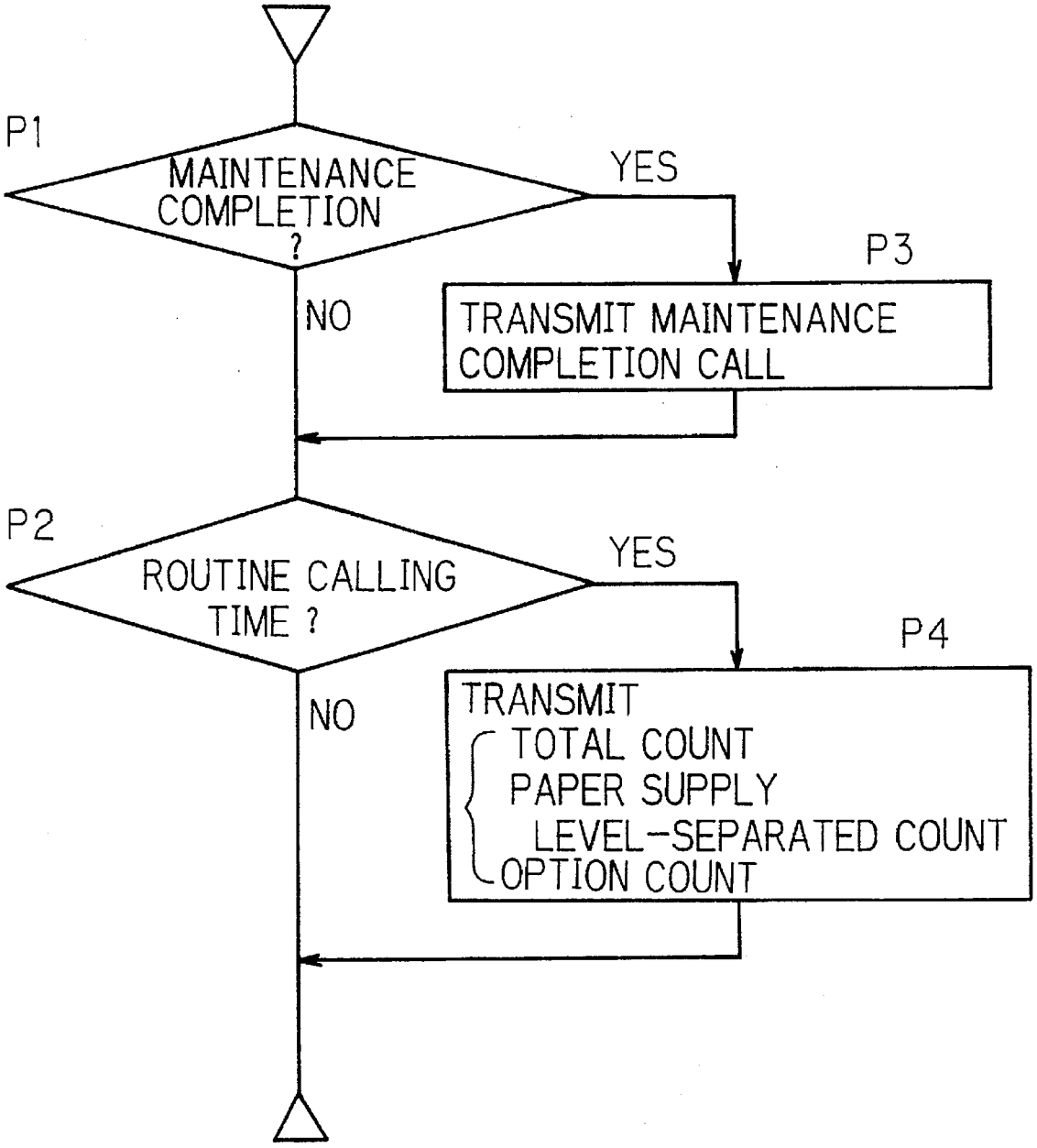
FIG. 11 is a control flow chart illustrating a maintenance reviewing routine of the maintenance supervising operation of the main control system.

At step S2 a decision is made as to whether a "maintenance complete" call has been received from a photocopier 2. When the serviceman has completed a maintenance job, he presses a "maintenance complete" key on the photocopier 2. When he does so, the maintenance complete call signal is transmitted from the photocopier 2 to the host computer 1. Step S2 corresponds to step P1 of a maintenance reviewing routine represented in FIG. 11, which will be described below.

At step S3 a decision is made as to whether any alterations to the maintenance reporting data have been made as input by the serviceman. The serviceman may make alterations to the maintenance reporting data when he has, for example, erroneously entered the job content or the type of maintenance.

At step S4 a decision is made as to whether a periodic reporting transmission has been received from a photocopier 2. A periodic reporting transmission is executed, for example, once per week in the middle of the night. The periodic reporting transmission transmits supervisory data to the host computer 1 containing the count values from the count table 21 stored in memory 14 of the photocopier 2, etc.

When maintenance reporting data is input at step S1, the operation shifts from step S1 to step S10. At step S10, the input data on the type of maintenance and the content of the job performed on each component is recorded in the job store area 17 of RAM 5.

The input job content data C accordingly establishes the current ranking number for each component. At step S11, the current ranking number in job store area 17 is updated to the next ranking number (in fact, to the ranking number which indicates the job that has just been done). At step S12 a maintenance assignment process is executed (to be explained) which determines job items for the next scheduled routine maintenance. When the maintenance completion call is received, the operation shifts from step S2 to step S13.

At step S13 the updating process for the ranking number (as in step S11) is executed, and at step S14 the same maintenance assignment setting process as in step S12 is executed.

When a change in the input maintenance reporting data is made, the operation shifts from step S3 to step S15. At step S15 the content of job store area 17 is overwritten with the input maintenance reporting data. At step S16 the updating process for the ranking number is executed, and at step S17 the maintenance assignment process is executed.

When a periodic transmission is received from photocopier 2, the operation shifts from step S4 to step S18. At step S18 the counts in usage counters 24*a* are updated according to the count values received via the periodic reporting transmission.

At step S19 a count remaining R, and a current rate of use K(%), are calculated for each component from a count U from the updated usage counters 24*a* and a count J from sanction counters 24*b*. Herein, the remaining count R is found from (J–U) and the rate of use K from (U/J)×100. At step S20, the values calculated for remaining count R and rate of use K are stored in another memory area of RAM 5 and in addition, the remaining count R and rate of use K for each component are displayed. At step S21, a decision is made as to whether the rate of use J has exceeded 100% and thus the components in question have attained life-span. If it is determined that this is the case, the operation shifts to step S22 and a life-span flag is switched on accordingly to indicate that the component has attained life-span.

For the maintenance assignment process, the maintenance reporting data immediately input and stored in job store area 17 is read out in step S30 of FIG. 10. This maintenance reporting data contains job content C and the type of maintenance M carried out during the most recent visit by the servicemen. In step S31, a decision is made as to whether the type of maintenance M is "repair maintenance", i.e., maintenance that has taken place between scheduled routine maintenance periods. Where it is "repair maintenance" the operation shifts to step S32. At step S32 a decision is made as to whether the job content C read out is "replacement." Where the job content C is "replacement," the operation shifts to step S33, and the ranking number stored in job area 17 is set to '0'. As a result, during the next routine maintenance, the serviceman will be instructed to perform the maintenance corresponding to ranking number '0'. At step S34, corresponding usage counter 24*a* in usage-counter store area 18 is reset to '0'.

Where job content C is not "replacement," the operation shifts from step S32 to step S35. At step S35 the maintenance work listed under the current ranking number N stored in job store area 17 is left as it is. Because the type of maintenance M completed here is "repair maintenance", and the job content C does not involve the replacement of components but instead involves "adjustment", "cleaning", or some other type of work, it will be sufficient for the serviceman to carry out the next routine maintenance in accordance with current ranking number N. Thus ranking number N is left as it is in step S35.

When in step S31 the type of maintenance M is not "repair maintenance," in other words where the type of maintenance M is "routine maintenance" or "regular+repair maintenance," the operation shifts to step S40. At step S40 a decision is made as to whether job content C read out is "replacement." Where job content C is not "replacement," the operation shifts from step S40 to step S41. At step S41, a decision-is made as to whether job content C read out is "ignore maintenance." Where job content C is not "ignore maintenance," the operation shifts from step S41 to step S42, and the ranking number N in job store area 17 is incremented by '1'. Because the type of maintenance M completed here is either "routine maintenance" or "routine+repair maintenance", and the job content C does not involve the replacement of components but instead involves "adjustment", "cleaning", or some other type of work, it will be sufficient for the serviceman to carry out the next routine maintenance in accordance with the next ranking number N. Thus the ranking number N is incremented by '1' in step S42.

Where job content C is "replacement," the operation shifts from step S40 to step S43, and the ranking number N in job store area 17 is returned to '0'. At step S44 the corresponding usage counter 24*a* of usage-counter store area 18 is reset to '0'.

Where job content C is, "ignore maintenance," the operation shifts from step S41 to step S45, and the ranking number N in the job store area 17 is left as it is. Herein, since no maintenance work is carried out at routine maintenance time, ranking number N is left as it is. When the processes in steps S34, S35, S42, S44 or S45 terminate, the operation shifts to step S50.

At step S50, a decision is made as to whether the life-span flag is on. Where the life-span flag is on, the operation shifts to step S51 and the life-span flag is switched off. At step S52, job content C is over-ridden and set to "replace," and the fact that the component has attained life-span is displayed. Where the life-span flag is not on, the operation shifts from step S50 to step S53.

At step S53, the ranking number N stored in job store area 17 is read out. Job content C is read from maintenance table 20 for the ranking number N which was read out. At step S54, job content C set at step S52 or job content C read out at step S53 is displayed on CRT 8*a* as the job item for the next scheduled routine maintenance. At step S55, the display contents are printed by printer 8*b*, and the process returns to that as indicated in FIG. 9.

Moreover, in photocopier 2 controller 11 operates in connection with a maintenance reviewing routine of the maintenance supervising operation. At step P1 in FIG. 11, a decision is made as to whether a maintenance completion process has been actuated. When the maintenance completion process is actuated, the operation shifts from step P1 to step P3, and a maintenance completion call is transmitted to host computer 1.

At step P2 it is determined whether it is the routine calling time of day. When it has become the routine calling time of day, the operation shifts from step P2 to step P4. At step P4 supervising data indicating the state of photocopiers 2 from the count values retained in counters 21 is transmitted to host computer 1. When these count values are received, the above-mentioned processes for judging component life span and setting maintenance job items are executed by the host computer 1.

Herein, the serviceman carries out succeeding routine maintenance having confirmed the job items for the next scheduled routine maintenance from the display or the printout. Thus, even if a component has been replaced through maintenance repairs between routine maintenance occasions, this fact will be reflected in the content of the job determined by the maintenance job item setting process. Accordingly, the maintenance supervising operation ensures there will be no redundancy in the job content of routine maintenance, and thereby improves efficiency of the maintenance work.

A maintenance supervising system according to the present invention may be applied to laser printers, fax machines, and similar image-reproducing systems instead of to photocopiers.

The types of maintenance, and the job items given in description of the preferred embodiment are examples only, and the invention is not limited to these.

The invention may be applied in situations wherein the photocopier and the host computer are not connected by telephone lines but are independently installed.

With a maintenance supervising system for an image-reproducing device in accordance with the invention, the job items are set according not only to routine maintenance but to the maintenance work actually carried out, such as repair maintenance. Therefore, changes can be made to the job content set for the next routine maintenance to reflect the fact that, for example, a replacement job has been carried out due to repair maintenance on an occasion other than that of routine maintenance. For this reason, since the serviceman sees the updated results which are output, he can accurately understand the job content to be performed at the time of the next routine maintenance. This improves the efficiency of the routine maintenance work carried out.

Given that in the maintenance reporting data the types of maintenance include "routine maintenance," non-routine "repair maintenance" and "regular and repair maintenance," and that job content includes "replacement," "ignore maintenance" and "other work," it is possible optionally to set routine maintenance work for a succeeding occasion at least according to whether or not the maintenance type is "repair maintenance," and whether or not the job content is "replacement." This further improves the efficiency of the routine maintenance procedure.

Moreover, when the type of maintenance accepted by the data storage means is "routine maintenance" or "routine and repair maintenance," wherein the microprocessor sets the head one of ranking numbers for the job contents when the job content is "replacement," sets the present one of the ranking numbers for the job contents when the job content is "ignore maintenance," and sets the next from the present one of the ranking numbers for the job contents when the job content is "other work," it is possible accurately to set the job contents for the succeeding routine maintenance work in response to the mediate type of maintenance.

Furthermore, when the type of maintenance accepted by the data storage means is "repair maintenance," wherein the microprocessor sets the head one of the ranking numbers for the job contents when the job content is "replacement," and sets the job content for the present one of the ranking numbers for the job contents when the job content is "other work," the job content for the next scheduled routine maintenance can be set accurately in response to the most recent type of maintenance.

Moreover, the data storage means, being further configured to retain a plurality of sanctioned image-formation counts, which hold component-by-component for each component a sanctioned number of image formations as a serviceable life-span before replacement, and configured to accept counts of image formations by the image-reproducing system, where it is arranged so as to determine the life of each component from an accepted count of image formations and the corresponding sanctioned image-formation count held in the means for holding a sanctioned image-formations number, components which have attained life-span can be replaced reliably during the next routine maintenance procedure.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image-reproducing system maintenance supervising system, comprising;

a microprocessor having an input device, a data storage means, and an output device connected thereto, wherein said data storage means stores a list of routine maintenance jobs for each of a plurality of serviceable components of said image reproducing system, said list of routine maintenance jobs arranged according to a ranking number list, each ranking number in said ranking number list corresponding to a corresponding maintenance interval in which routine maintenance is to take place on a corresponding one of said components;

said data storage means further stores maintenance reporting data on any routine and non-routine maintenance carried out on any one of said components, said maintenance reporting data including information on type of maintenance performed and job content, said maintenance reporting data input via said input device;

said microprocessor determines said ranking numbers in said ranking number list in response to input of said maintenance reporting data and said microprocessor determines corresponding ones of said components requiring routine maintenance based upon determined ones of said ranking numbers; and said output means outputs portions of said list of routine maintenance jobs corresponding to said components requiring routine maintenance.

2. An image-reproducing system maintenance supervising system according to claim 1, wherein said type of maintenance is classified at least as "routine maintenance", non-routine "repair maintenance" and "routine and repair maintenance"; and said job content is classified at least as "replacement", "ignore maintenance", and "other work".

3. An image-reproducing system maintenance supervising system according to claim 2, wherein when said type of maintenance is classified as "routine maintenance", said microprocessor resets said ranking number to a beginning of said ranking number list when said job content is classified as "replacement";

said microprocessor leaves said ranking number as is when said job content is classified as "ignore maintenance";

said microprocessor advances said ranking number up one rank when said job content is classified as "other work".

4. An image-reproducing system maintenance supervising system according to claim 2, wherein when said type of maintenance is classified as "routine and repair maintenance", said microprocessor resets said ranking number to a beginning of said ranking number list when said job content is classified as "replacement";

said microprocessor leaves said ranking number as is when said content is classified as "ignore maintenance"; and said microprocessor advances said ranking number up one rank when said job content is classified as "other work".

5. An image-reproducing system maintenance supervising system according to claim 2, wherein when said type of maintenance is classified as "repair maintenance", said microprocessor resets said ranking number to a beginning of said ranking number list when said job content is classified as "replacement"; and said microprocessor leaves said ranking number as is when said job content is categorized as "other work".

6. An image-reproducing system maintenance supervising system according to claim 1, wherein said data storage means further stores sanctioned image formation counts for each corresponding one of said components of said image-reproducing system, said sanctioned image formation counts each being a number of image formations predetermined to indicate that a serviceable life-span of said corresponding one of said components has been reached; and said microprocessor determines whether each corresponding one of said components has attained said serviceable life-span by comparing an image formation count of each of said serviceable component with said sanctioned image formation count for each corresponding one of said component.

7. An image-reproducing system maintenance supervising system, comprising:

a controller, said controller having a microprocessor, an input device, a data storage means, and an output device all connected to said microprocessor, said controller connected to at least one image-reproducing device;

said data storage means configured to store a list of routine maintenance jobs for each one of a plurality of serviceable components of said image-reproducing device, said list of routine maintenance jobs arranged according to a ranking number list, each ranking number in said ranking number list corresponding to one of a plurality of maintenance intervals in which routine maintenance is to occur on each of said components or said image-reproducing device;

said data storage means further configured to store maintenance reporting data on performed routine and non-routine maintenance conducted on corresponding ones of said components of said image-reproducing device, said maintenance reporting data including information on type of maintenance performed and job content, said maintenance reporting data input via said input device;

said microprocessor being configured to determine said ranking numbers in said ranking number list in response to input to said maintenance reporting data and further determine said maintenance to be carried out at each of said maintenance intervals in response to data in said faulting number list and said maintenance reporting data, said microprocessor also configured to correspondingly update said list of routine maintenance jobs;

said output means being configured to output portions of said list of maintenance items corresponding to said maintenance to be carried out at at least one of said maintenance intervals.

8. The image-reproducing system maintenance supervising system as set forth in claim 7, further comprising a plurality of image-reproducing devices connected to said controller, said controller being configured to determine said ranking number list and said maintenance to be carried out for each of said plurality of image-reproducing devices.

9. The image-reproducing system maintenance supervising system, as set forth in claim 7 wherein said data storage means is configured to store image formation count information related to usage of said image-reproducing device and said microprocessor is configured to determine when at least one of said maintenance intervals has elapsed in response to said usage of said image-reproducing device.

* * * * *